US009189006B2

(12) United States Patent
Gueltig

(10) Patent No.: US 9,189,006 B2
(45) Date of Patent: Nov. 17, 2015

(54) POWER SOURCE WITH OVERLOAD PROTECTION

(75) Inventor: Michael Gueltig, Stutensee (DE)

(73) Assignee: INIT Innovative Informatikanwendungen in Transport-, Verkehrs- und Leitsystemen GmbH, Karlsruhe (DE)

( * ) Notice: Subject to any disclaimer, the term of this patent is extended or adjusted under 35 U.S.C. 154(b) by 260 days.

(21) Appl. No.: 13/885,947

(22) PCT Filed: Oct. 11, 2011

(86) PCT No.: PCT/DE2011/050044
§ 371 (c)(1),
(2), (4) Date: May 16, 2013

(87) PCT Pub. No.: WO2012/065601
PCT Pub. Date: May 24, 2012

(65) Prior Publication Data

US 2013/0234693 A1 Sep. 12, 2013

(30) Foreign Application Priority Data

Nov. 16, 2010 (DE) ..... 10 2010 051 406

(51) Int. Cl.
*G05F 3/02* (2006.01)
*G05F 3/08* (2006.01)

(52) U.S. Cl.
CPC ... *G05F 3/02* (2013.01); *G05F 3/08* (2013.01)

(58) Field of Classification Search
CPC ..... G05F 3/08
USPC ..... 323/304–317
See application file for complete search history.

(56) References Cited

U.S. PATENT DOCUMENTS

| | | | | |
|---|---|---|---|---|
| 3,114,872 | A | 12/1963 | Allard | |
| 3,701,004 | A | 10/1972 | Tuccinardi et al. | |
| 3,900,790 | A | 8/1975 | Ohsawa | |
| 4,588,940 | A * | 5/1986 | Embree et al. | 323/313 |
| 4,757,176 | A * | 7/1988 | Suzuki et al. | 219/627 |
| 6,088,208 | A * | 7/2000 | Yamaguchi | 361/103 |
| 2011/0298780 | A1 * | 12/2011 | Murakami | 345/212 |

FOREIGN PATENT DOCUMENTS

| | | | |
|---|---|---|---|
| DE | 2328402 | A1 | 12/1973 |
| JP | 2228059 | A | 9/1990 |
| NL | 7307920 | A | 12/1973 |

OTHER PUBLICATIONS

International Searching Authority, Written Opinion (Translation) for International Application No. PCT/DE2011/050044, mailed Apr. 22, 2013, 7 pages, European Patent Office, The Netherlands.

(Continued)

*Primary Examiner* — Nguyen Tran
*Assistant Examiner* — Kyle J Moody
(74) *Attorney, Agent, or Firm* — Alston & Bird LLP

(57) ABSTRACT

Power source, in particular for use in a databus in public means of transportation, wherein the power source has a first transistor (T2), and wherein in a normal operating mode of the power source the current ($I_A$) which is conducted through the first transistor (T2) is determined by a first resistor (R3) at the emitter of the first transistor (T2), is characterized with respect to safe operation accompanied by the smallest possible space requirement and lowest possible manufacturing costs in that a temperature-dependent resistor (RV1) is thermally coupled to the first transistor (T2) and that the temperature-dependent transistor (RV1) is connected to the power source in such a way that when the temperature of the first transistor (T2) is rising the temperature-dependent resistor (RV1) influences the voltage across the first resistor (R3) and thereby brings about a reduction in the output current ($I_A$) of the power source.

14 Claims, 3 Drawing Sheets

(56) References Cited

OTHER PUBLICATIONS

Limann, Otto, "Elektronische Thermoschalter,"*Kurzberichte*, Elektronik 1975 Heft 5, Bd. 24, pp. 89-90.

International Searching Authority, International Search Report ("ISR") and Written Opinion for International Application No. PCT/DE2011/050044, mailed Apr. 22, 2013, 13 pages, European Patent Office, The Netherlands.

* cited by examiner

State of the Art

POWER SOURCE WITH OVERLOAD PROTECTION

CROSS REFERENCE TO RELATED APPLICATIONS

This application is a national stage application, filed under 35 U.S.C. §371, of International Application No. PCT/DE2011/050044, filed Oct. 11, 2011, which claims priority to and the benefit of German Application No. 10 2010 051 406.3, filed Nov. 16, 2010, the contents of both of which are hereby incorporated by reference in their entirety.

BACKGROUND

1. Technical Field

The invention relates to a power source, especially for use with a data bus in public transportation, wherein the power source has a first transistor and wherein, in normal operation of the power source, the current emitted by the first transistor is determined by a first resistor on the emitter of the first transistor.

2. Description of Related Art

In some areas of technology, power sources or current sinks with low precision requirements are needed. One example of this is the supply of a data bus, e.g. the response bus of the IBIS and/or VDS vehicle bus, which is used in public transportation. The IBIS vehicle bus is used to control ticket validators, interior displays, etc. in buses or streetcars from a central control unit. The control unit assumes the function of a master; the individual users connected to the bus are slaves. By way of the call bus, the master sends a message to the individual slaves and the slaves report their status back on the response bus. The schematic structure of the bus is shown in FIG. 1. The master has a power source that outputs approx. 100 mA to the response bus. A slave that wants to transmit a message on the response bus, connects the line to ground according to the message to be sent using a transistor (a MOSFET in the figure) and thereby creates a bit pattern on the response bus. The voltage swing of the bit pattern typically lies at 28 V. In or at the master, the bit pattern is evaluated and the transmitted message is extracted.

In this or similar applications, usually simply structured power sources are used that fulfill only low requirements for precision of the output current. Simple circuits comprise one or more bipolar transistors for driving the output current and few circuit elements. During the design of the circuit, among other things, attention must be paid to the maximum power loss in the transistor(s). To prevent overheating, frequently a cooling surface or a heat sink is used for a power transistor. However, because of this the power source becomes much more voluminous and—with the use of heat sinks—the manufacturing becomes more expensive and complicated. To avoid the use of heat sinks, sometimes the current supplied by the power source is distributed to several power transistors and a cooling surface is implemented on the circuit board. In this case, frequently SMD (surface mount device) power transistors are used. Still, a comparatively large cooling surface is necessary, which involves a not inconsiderable space requirement on the circuit board and thus costs. In addition, it is possible that a developer may take the circuit section over to a new circuit board and not provide adequately large cooling surfaces. This causes the risk of a component overload.

Therefore, the present invention is based on the object of designing and further developing a power source of the type named at the beginning that can achieve safe operation of the power source simultaneously with the smallest possible space requirement. In this case, the power source can especially be used with a data bus in public transportation.

BRIEF SUMMARY

According to the invention, the object above is achieved by the characteristics of the claims. According to this, the power source being discussed is characterized in that a temperature-dependent resistor is thermally coupled with the first transistor and that the temperature-dependent resistor is in circuit with the power source in such a way that during increasing temperature of the first transistor, the temperature-dependent resistor influences the voltage and thereby produces a reduction in the output current.

In a manner according to the invention, it is recognized at first that in many applications the power source cannot be continuously loaded in the limit range. Rather, a maximum power loss in the transistors frequently only occurs in the case of a fault. For example, in an IBIS vehicle bus in normal operation, the power source can only be loaded for approximately one-tenth to one-fifth of the time. Very high loads occur only in the case of a fault, e.g. a defect in a device that is connected or a wiring fault. Frequently, a short circuit on the line occurs then. Since data communication is no longer possible anyway in these cases, the power source does not have to supply the current continuously. However, to date, the power source has always been designed for this case. This means that, in the case of a short circuit, the power loss must be discharged via cooling surfaces or heat sinks.

During a short circuit, a power loss occurs that results as the product of the maximum supply voltage and the current supplied by the power source. For example, with a voltage supply of 32 V and a current of 100 mA, the power loss is 3.2 W.

However, according to the invention, during the design of the cooling capabilities for the circuit, it is sufficient to design the power source for normal operation and the average current that flows. This means that only the far lower current requirement of normal operation has to be covered and the power loss that then occurs has to be dissipated. For example, if the named IBIS vehicle bus is only loaded one-fifth of the time, a power loss of 28 V×100 mA/5=0.56 W occurs. This clearly lower power loss requires much smaller cooling solutions, so the circuit requires less surface area and in general does not need any heat sinks.

To permit safe operation even in the case of a short circuit, a protective measure is taken that intervenes in the case of a fault and prevents overheating of the transistor. To do this, according to the invention, a temperature-dependent resistor is thermally coupled with the power source transistor. The temperature-dependent resistor is in circuit with the power source as a temperature sensor in such a way that the power output, and thus the power loss, is reduced.

Simple power sources with the use of a transistor have a resistor on the transistor emitter, which determines the maximum power output of the power source in wide ranges. According to the invention, the temperature-dependent resistor intervenes at exactly this point, namely in that it is connected in such a way that with increasing temperature of the transistor, the temperature-dependent resistor influences the voltage across the resistor on the transistor emitter. If the voltage drops, only a lower current can flow through the resistor and because of this, in turn the output current emitted by the power source is reduced. This means that if the circuit is loaded with a current that is too high, the transistor supplying the output current heats up. Because of the thermal coupling of the transistor with the temperature-dependent resistor, the temperature of the temperature-dependent resistor increases. In turn, this acts on the resistor and leads to a reduction in the output current of the power source. In this way, a type of feedback occurs that provides for prevention of an overload of the transistor and limiting of the current.

To simplify the further discussion, the transistor that drives the output current of the power source is designated as the first transistor. This does not mean that the first transistor always and exclusively comprises a single transistor. Rather, several transistors can be connected in parallel that mutually drive the output current. In such a case, the temperature-dependent resistor can still be thermally coupled with all the transistors of the driver stage. For example, it would be conceivable for four SMD power transistors to be soldered in a rectangle on the circuit board and the temperature-dependent resister to be mounted in the center.

In an exemplary design of the power source, the temperature-dependent resistor is made up of an NTC (negative temperature coefficient) resistor. These so-called pyroelectric conductors are better conductors with increasing temperature, i.e. the resistance drops with increasing temperature. NTCs with many different designs are known in practice.

In an exemplary manner, the first transistor is a pnp transistor. The use of pnp transistors has the advantage that power sources can be constructed, in which an output current can be driven toward ground. This makes handling them easier, for example in bus systems. However, an npn transistor can also be used for the power source according to the invention. The mechanisms described apply analogously.

In an exemplary design of the power source, the temperature-dependent resistor has two connections, of which one is connected to the base of the first transistor and the second of which is connected to the end of the resistor on the first transistor emitter turned away from the transistor. The expression "end turned away from the transistor" is understood in electrical terms, i.e. the end of the resistor turned away from the transistor is the end of the resistor not connected to the transistor. Because of this type of wiring, the temperature-dependent resistor creates a type of bypass that reduces the voltage over the resistor on the transistor emitter and reduces the base-emitter voltage of the transistor.

To improve the temperature stability of the power source, a reference voltage can be generated. With the wiring of the temperature-dependent resistor described above, the reference voltage can be applied across the serial connection of the resistor on the emitter of the first transistor and the emitter-base section of the first transistor. Also, the reference voltage is across the temperature-dependent resistor, which is connected parallel to the named series circuit.

In an exemplary manner, the reference voltage is generated with the use of one diode or a series connection of several diodes (i.e., two or more diodes). Thus a reference voltage occurs as a multiple of the knee voltage of the diodes used. For example, by series connection of two Si diodes, a reference voltage of 1.2 V can be generated. For the sake of completeness, reference is made to the fact that the reference voltage can also be generated in another way. In this way, for example, a reference voltage source can be used.

To improve the independence of the output current from the supply voltage, a current sink can be provided between base and collector of the first transistor. The current sink consists of a second transistor, on the emitter of which a resistor is mounted. In parallel to the base-emitter section of the second transistor and the resistor on the emitter of the second transistor, one or more diodes are connected for generating a reference voltage. The second transistor is designed as an npn transistor.

According to various embodiments, the base of the second transistor is connected by way of a resistor to the voltage source that supplies the power source with energy.

For dissipating the power loss of the first transistor, this is connected thermally to a cooling surface. This cooling surface can be formed as a part of the circuit board on which the power source is designed. In this case, it makes sense to dimension the cooling surface in such a way that the current limiter, by means of the temperature-dependent resistor, does not respond in normal operation. This means that the cooling surface and the heat dissipation thereby provided are dimensioned such that the temperature-dependent resistor has only a slight, or no, influence on the output current of the power source. In normal operation, the power source is loaded as planned, i.e., no short circuit currents occur. The power limiter does not respond until more current is drawn from the power source than in normal operation.

A thermal coupling between the temperature-dependent resistor and the first transistor can be facilitated in that the temperature-dependent resistor and the transistor are mounted close to each other. The thermal coupling can be improved in that a heat conducting means is mounted between the first transistor and the temperature-dependent resistor. When the transistor is mounted on a cooling surface, the thermal coupling can be achieved in that the temperature-dependent resistor is thermally coupled with the cooling surface. If the cooling surface is formed of circuit board material, there is a very good thermal conductor, usually copper. Because of this, the temperature-dependent resistor reacts very quickly to heating of the first transistor and load peaks can be intercepted very quickly.

According to various embodiments, the power source provides a consumer, which, on average, stresses the power source less than 50% of the time per time unit. In an exemplary manner, the consumer only stresses the power source less than 20% of the time. In another exemplary manner, the power source is only stressed by the consumer less than 10% of the time. Such a loading scenario occurs, for example, in the IBIS bus that has already been mentioned. Reference is made again to the fact that the protective circuit and the cooling surfaces are dimensioned with regard to the average power loss of the power source. However, a clearly higher current can be drawn in normal operation. The only prerequisite is that, on average, the power source is only loaded in such a way that the first transistor does not heat above the defined temperature. If the temperature increases above that, the protective circuit limits the output current.

BRIEF DESCRIPTION OF THE DRAWINGS

There are now various options for designing and further developing the teaching of the present invention in an advantageous manner. For this purpose, on one hand, reference is made to the claims and, on the other, to the following explanation of a exemplary embodiment of the invention with the use of the drawings. In connection with the explanation of the-exemplary embodiment of the invention with the use of the drawings, various designs and further developments of the teaching are explained. In the drawings:

DETAILED DESCRIPTION OF VARIOUS EMBODIMENTS

Figure 1:
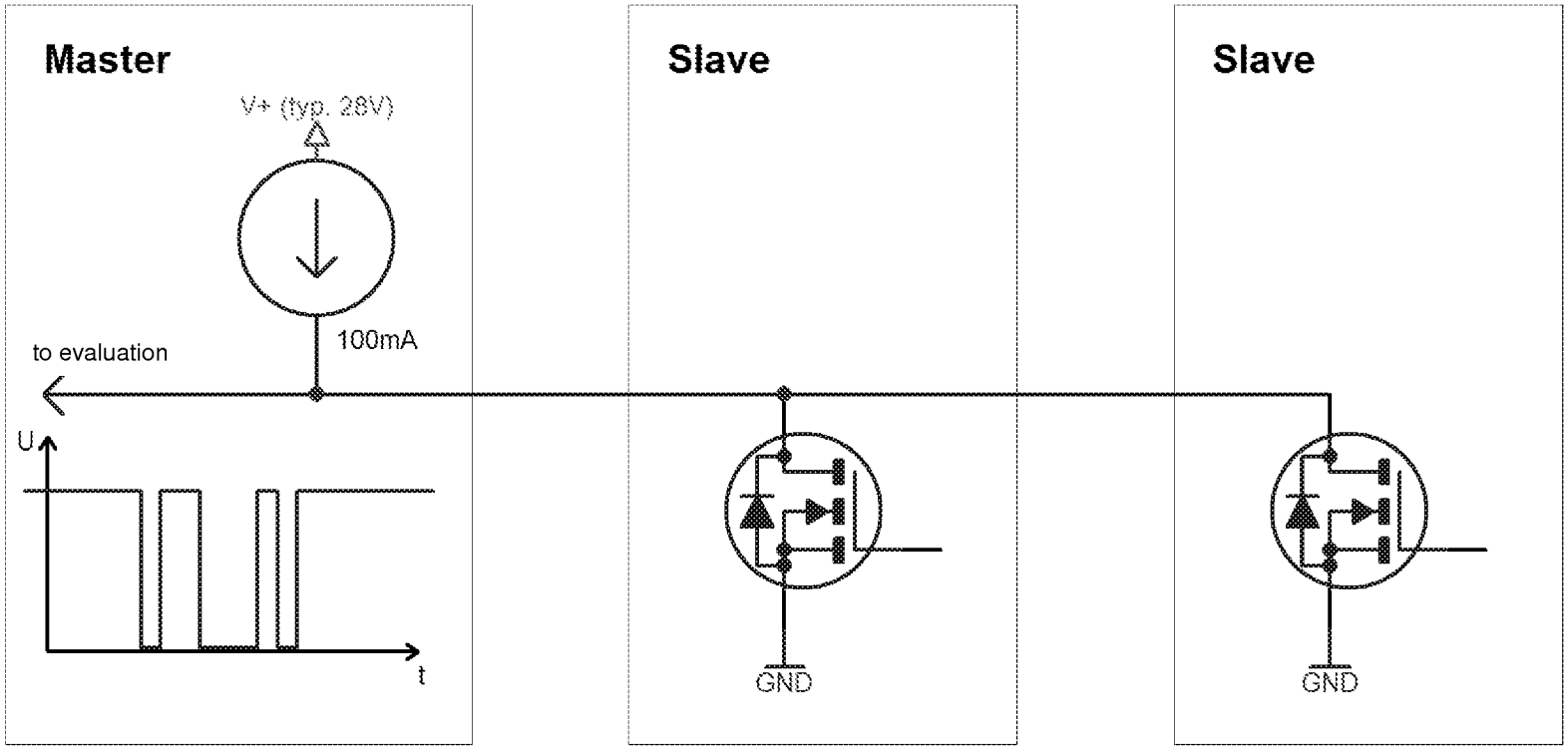
FIG. 1 shows the schematic structure of a response bus, in which a power source according to the invention can be used, and a typical voltage curve on the bus master.

FIG. 1 shows a schematic structure of a response bus and a typical voltage curve during data transmission in an IBIS vehicle bus. More details can be found in the introductory section of the description.

Figure 2:
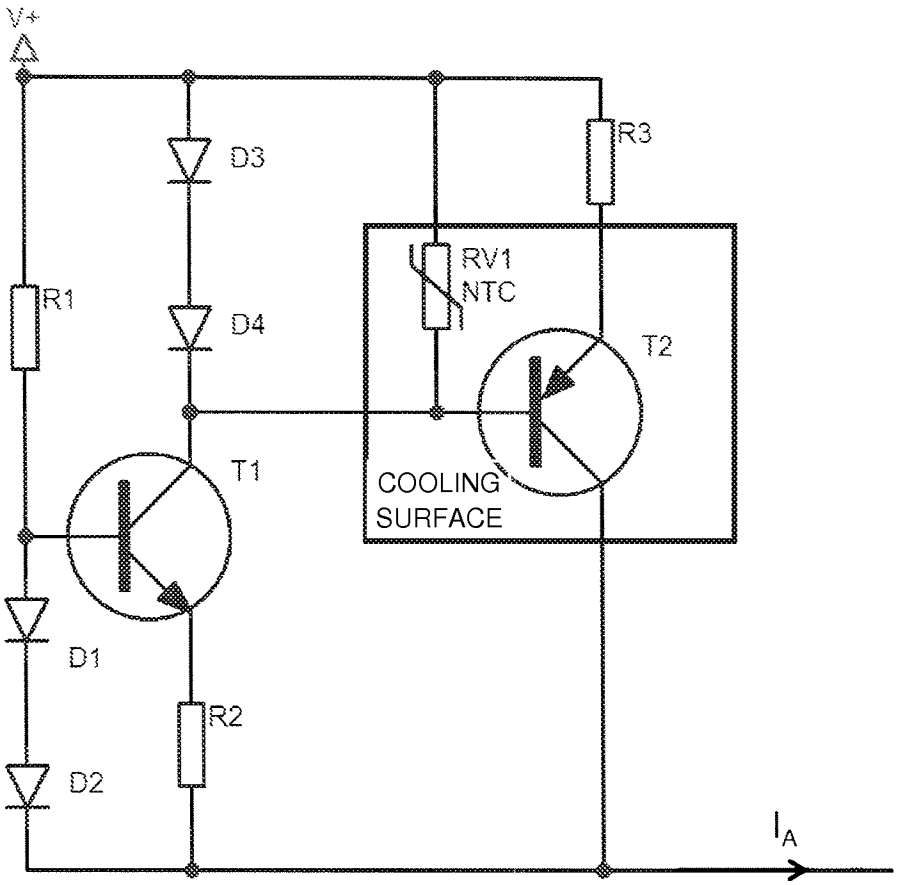
FIG. 2 shows an exemplary embodiment of the power source according to the invention and FIG. 3 shows the exemplary embodiment according to FIG. 2 with an exemplary selection of components.

FIG. 2 shows an exemplary embodiment of a power source according to the invention. The power source is connected to a supply voltage V+ and supplies an output current $I_A$. The output current $I_A$ essentially flows through a first resistor R3 that is connected to the voltage supply V+ and the emitter of a first bipolar transistor T2. The first transistor T2 is designed as a pnp transistor. A temperature-dependent resistor RV1 is connected in parallel to the first resistor R3 and the emitter-base section of the first transistor T2. In turn, a series circuit of two diodes D3 and D4 is connected to the temperature-dependent resistor. The base of the first transistor T2 is connected to the collector of a second bipolar transistor T1. The emitter of the second transistor T1 is connected to a second resistor R2. The other end of the second resistor R2 is connected to the collector of the first resistor T2 and the output of the power source. A series circuit of two diodes D1 and D2 is connected in parallel to the base-emitter section of the second transistor T1 and the second resistor R2. The base of the second bipolar transistor T1 is also connected to a third resistor R1, the other end of which is connected to the voltage source V+.

As soon as the output of the circuit is stressed, i.e., a current $I_A$ will be output by the power source, the third resistor R1, creates a voltage drop of 0.6 V in each of the diodes D1 and D2. Thus a voltage drop of approx. 1.2 V occurs over the series circuit of D1 and D2. This voltage forms a reference voltage that is applied by way of the base-emitter section of the second transistor T1 and the second resistor R2. In this way, a simple current sink is formed by D1, D2, T1 and R2. For example, the current sink can have an output current of 2 mA.

In turn, the output current of the current sink creates a voltage drop of approx. 1.2 V together in the diodes D3 and D4. This reference voltage is applied, in turn, by way of the first resistor R3 and the emitter-base section of the first transistor T2 and by way of the temperature-dependent resistor RV1. Because of this voltage at the base of the first transistor T2, the circuit of T2 and T3 act as a power source. An example output current $I_A$ is 100 mA. The reference voltage formed by the diodes D3 and D4 provides for a certain compensation of the transistor temperature drift here. The circuit made up of D1, D2, T1 and R2 provides for independence from the supply voltage of the power source within certain limits.

The temperature-dependent RV1 and the remaining circuit are dimensioned in such a way that in normal operation of the power source, the temperature-dependent resistor RV1 has a negligible, or at least very little, influence on the behavior of the power source. Here normal operation defines the usual load on the power source as it has been specified during the dimensioning of the power source. For example, during use of the power source in connection with an IBIS vehicle bus, an average load over one-fifth of the time is assumed, as well as a supply voltage of 32 V, a voltage swing of 28 V in the data signal to be transferred and an output current from the power source of 100 mA.

In this case, the power source would be dimensioned for a power loss of 28 V×100 mA/5=0.56 W. Thus normal operation means that, as an average over time, the first transistor T2 is not loaded with significantly more than the said 0.56 W.

If the power source is loaded with a definitely higher current, e.g. in the case of a short circuit, the temperature of the first transistor T2 increases more. Because of the thermal coupling of the variable resistor RV1 with the first transistor T2, the temperature-dependent resistor RV1 heats up. The temperature-dependent resistor RV1 is designed as NTC, so with increasing temperature its resistance drops. Because of this, with increasing temperature, increasingly more current flows through the temperature-dependent resistor, so the voltage difference between base and emitter of the first transistor T2 is no longer determined from the series circuit of D3 and D4, but rather from the temperature-dependent resistor RV1. Starting at a specific temperature, this leads to a case in which the voltage drops over R3 and, because of this, the power output of the power source is in turn restricted. In turn, a restriction of the power output has a drop in the power source power loss as a consequence. In this way, the circuit itself stabilizes and only a maximum current is supplied, independently of the load. At the same time, in normal operation of the circuit, there is no influence on the output current. This means that the power source behaves like any power source without protective measures. If a short circuit or an excessively high load on the power source is no longer present, the first transistor T2 and the temperature-dependent resistor RV1 cool again and the power source returns to normal condition. In this way, a self-reset of the protective circuit is achieved. The cooling surface of the power source no longer has to be designed for the fault case. Rather, it is sufficient to select the cooling surface in such a way that in normal operation, the transistor does not heat above the response threshold of the protective circuit.

Figure 3:
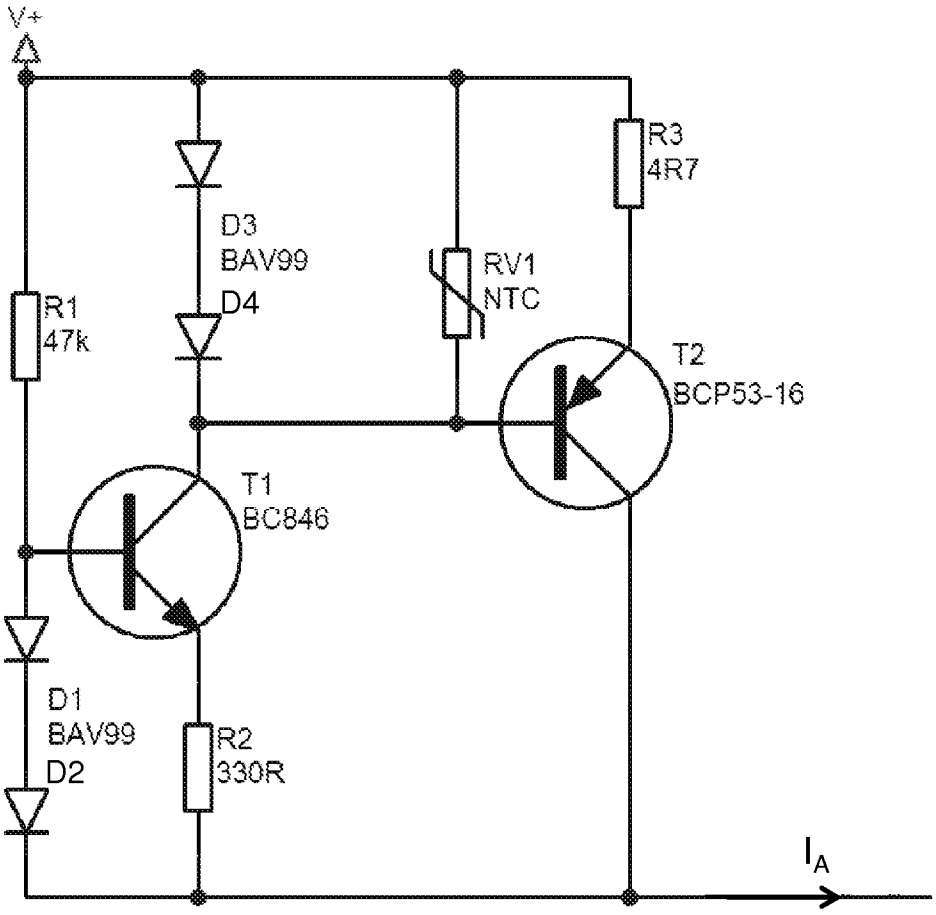

A possible dimensioning of the power source is shown in FIG. 3. The first resistor R3 is formed by a 4.7 Ω resistor. The second resistor R2 is 330 Ω, the third resistor R1 is 47 kΩ. The diodes D1 and D2 and/or D3 and D4 are formed by double diodes, model BAV99. An NTC from EPCOS, the B57371V2223+060 is used as temperature-dependent resistor RV1. The first transistor T2 is formed by a BCP53-16. The second transistor T1 is formed by a BC846. In this way, a power source that supplies a current of typically between approx. 90 mA and 110 mA in a temperature range from −40 to +70° C. is produced. For example, in the case of a short circuit, if the NTC is heated to 120° C., the output current $I_A$ of the power source is already reduced to approx. 20 mA.

The circuit named as an example above, offers the considerable advantage that clearly lower cooling surfaces are necessary. Because of this, the entire power source can be built so that it is more economical and saves space. Heat sinks or several power transistors that would be necessary without the protective circuit according to the invention are not needed, which in turn has a positive effect on the costs of the power source. In the case of a short circuit, the power loss in the device is clearly lower and the entire device, i.e., the device in which the power source is installed, definitely heats up less.

With respect to additional advantageous designs of the device according to the invention, to prevent repetitions, reference is made to the general section of the description, as well as the claims included.

Finally, explicit reference is made to the fact that the exemplary embodiments of the device according to the invention described above are used only for explanation of the claimed teaching, but the teaching is not restricted to the exemplary embodiments.

REFERENCE NUMBER LIST

R1 Third resistor
R2 Second resistor
R3 First resistor
RV1 Temperature-dependent resistor
T1 Second transistor
T2 First transistor
D1 Diode
D2 Diode
D3 Diode
D4 Diode
V+ Supply voltage
$I_A$ Output voltage

The invention claimed is:

1. A power source for use with a data bus in public transportation, the power source comprising:

a first transistor (T2) comprising an emitter, a collector, and a base, wherein the first transistor emits an output current of the power source; and a temperature-dependent resistor (RV1) thermally coupled with the first transistor (T2), wherein due to the thermal coupling an increase in a temperature of the first transistor results in an increase in a temperature of the temperature-dependent resistor, wherein:

during normal operation of the power source, the output current ($I_A$) emitted by the first transistor (T2) is determined by a first resistor (R3) on the emitter of the first transistor (T2);

the temperature-dependent resistor (RV1) is connected with the power source in such a way that, during the increasing in the temperature of the first transistor (T2) due to a current flow through the first transistor, the temperature-dependent resistor (RV1) influences a voltage across the first resistor (R3) and thereby produces a reduction in the output current ($I_A$) of the power source and prevents an overload of the first transistor and a limiting of the output current.

2. The power source according to claim 1, wherein the temperature-dependent resistor (RV1) is an NTC (negative temperature coefficient) resistor, a resistance of which decreases with the increase in the temperature of the NTC resistor.

3. The power source according to claim 1, wherein the first transistor is formed by a pnp transistor.

4. The power source according to claim 1, wherein:

a connection of the temperature-dependent resistor (RV1) is connected to the base of the first transistor (T2); and a second connection of the temperature-dependent resistor (RV1) is connected to an end of the first resistor (R3) turned away from the first transistor (T2).

5. The power source according to claim 1, wherein:

a reference voltage is generated; and the reference voltage is applied across the serial connection of the first resistor (R3) and an emitter-base section of the first transistor (T2).

6. The power source according to claim 5, wherein the reference voltage is generated with at least one of a diode or a series circuit of several diodes.

7. The power source according to claim 1, wherein:

the power source has a current sink that is connected to the base and the collector of the first transistor (T2).

8. The power source according to claim 7, wherein the base of the second transistor is connected to a voltage source by way of a third resistor (R1).

9. The power source according to claim 7, wherein the current sink comprises:

a second transistor (T1) comprising an emitter, a collector, and a base, a second resistor (R2) coupled to the emitter of the second transistor (T1), and one or more diodes connected in series between the base of the second transistor and the end of the second resistor (R2) turned away from the second transistor.

10. The power source according to claim 1, wherein:

the first transistor is thermally connected to a cooling surface; and the cooling surface is configured such that a current limitation by way of the temperature-dependent resistor (RV1) does not respond during operation.

11. The power source according to claim 10, wherein the temperature-dependent resistor (RV1) and the first transistor are mounted adjacent each other on a common cooling surface.

12. The power source according to claim 1, wherein the power source supplies a consumer, which, on average, applies a load to the power source less than 50% of the time per time unit.

13. The power source according to claim 1, wherein the power source supplies a consumer, which, on average, applies a load to the power source less than 20% of the time per time unit.

14. The power source according to claim 1, wherein the power source supplies a consumer, which, on average, applies a load to the power source less than 10% of the time per time unit.

* * * * *